US010961799B2

(12) United States Patent
Poedjono et al.

(10) Patent No.: US 10,961,799 B2
(45) Date of Patent: Mar. 30, 2021

(54) FLANGE SYSTEM

(71) Applicant: Cameron International Corporation, Houston, TX (US)

(72) Inventors: Benny Poedjono, Sugar Land, TX (US); Jose Melguizo, Katy, TX (US); Pheng Aun Soh, Houston, TX (US); Craig Cotton, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 16/408,469

(22) Filed: May 10, 2019

(65) Prior Publication Data

US 2019/0352992 A1 Nov. 21, 2019

Related U.S. Application Data

(60) Provisional application No. 62/672,422, filed on May 16, 2018.

(51) Int. Cl.

| | |
|---|---|
| ***E21B 33/03*** | (2006.01) |
| ***E21B 19/02*** | (2006.01) |
| ***E21B 15/00*** | (2006.01) |

(52) U.S. Cl.

CPC ..... *E21B 33/03* (2013.01); *E21B 15/00* (2013.01); *E21B 19/02* (2013.01)

(58) Field of Classification Search

CPC ..... E21B 33/02; E21B 15/00; E21B 19/02
See application file for complete search history.

(56) References Cited

U.S. PATENT DOCUMENTS 2,314,630 A * 3/1943 Ratigan ..... E21B 19/02 403/66
2,689,611 A * 9/1954 Martinson ..... E21B 33/00 166/85.2
2,943,682 A * 7/1960 Ingram, Jr. ..... E21B 33/072 166/77.1

(Continued)

OTHER PUBLICATIONS

International Search Report and Written Opinion for International patent application PCT/US2019/031657 dated Aug. 12, 2019 (13 pages).

(Continued)

*Primary Examiner* — Aaron L Lembo
(74) *Attorney, Agent, or Firm* — Fletcher Yoder, P.C.

(57) ABSTRACT

A technique enables maintenance of sufficient clearance between a wellhead and, for example, a mobile rig. The technique facilitates support of a cable, e.g. an antenna suspension cable, at the wellhead without detrimentally affecting the desired clearance. According to an embodiment, a flange system is used in combination with a cable clamp assembly at a wellhead. The flange system may comprise a flange having a connector portion configured for coupling with the wellhead. The flange also comprises a cylinder portion coupled to the connector portion such that the cylinder portion extends into a corresponding bore of the wellhead. The cable clamp assembly is configured to clamp around and support a cable extending down through the wellhead. The cable clamp assembly is supported within the cylinder portion of the flange such that the cable clamp assembly is at least partially disposed within the wellhead.

20 Claims, 5 Drawing Sheets

(56) References Cited

U.S. PATENT DOCUMENTS

| | | | | |
|---|---|---|---|---|
| 3,228,703 | A * | 1/1966 | Wilson | E21B 33/08 277/330 |
| 3,653,671 | A * | 4/1972 | Shipes | E21B 33/128 277/328 |
| 3,688,840 | A * | 9/1972 | Curington | E21B 33/038 166/341 |
| 4,718,487 | A | 1/1988 | Lanmon, II | |
| 5,148,865 | A | 9/1992 | Reed | |
| 6,202,743 | B1 | 3/2001 | Moore | |
| 8,499,838 | B2 * | 8/2013 | Fraser | E21B 33/038 166/338 |
| 8,826,990 | B2 * | 9/2014 | Botich | E21B 33/035 166/338 |
| 9,033,050 | B2 * | 5/2015 | Long | E21B 41/04 166/336 |
| 9,080,710 | B2 * | 7/2015 | Norem | F16L 55/053 |
| 10,030,509 | B2 * | 7/2018 | Mulholland | E21B 33/04 |
| 10,119,353 | B2 * | 11/2018 | Mullins | F16L 1/26 |
| 10,619,443 | B2 * | 4/2020 | Peer | E21B 19/004 |
| 10,648,267 | B2 * | 5/2020 | Hestetun | H01R 13/523 |
| 10,669,804 | B2 * | 6/2020 | Kotrla | E21B 33/06 |
| 2011/0017444 | A1 | 1/2011 | McCollin | |
| 2014/0216757 | A1 | 8/2014 | Kleppa | |

OTHER PUBLICATIONS

PCT International Preliminary Report; Application No. PCT/US2019/031657; dated Nov. 17, 2020; 9 pages.

* cited by examiner

FLANGE SYSTEM

CROSS-REFERENCE TO RELATED APPLICATION

The present document is based on and claims priority to U.S. Provisional Application Ser. No. 62/672,422, filed May 16, 2018, which is incorporated herein by reference in its entirety.

BACKGROUND

Wells are drilled at great expense to access oil and natural gas below the surface of the earth. Such wells may be drilled on dry land or in a subsea environment. Because of the great expense in drilling wells, sensors often are placed in a well to monitor the condition of the well. Monitoring may occur over the life of the well and may include monitoring after the well is no longer producing oil and/or natural gas. Communication with the sensors can be difficult due to, for example, substantial distance between the sensors and the receivers. To facilitate communication with the downhole sensors, an antenna may be lowered into the well and placed in closer proximity to the sensors. Data communicated from the sensors is received by the antenna and then transmitted from the antenna through a cable to a receiver which may be located at the surface. The receiver is part of a telemetry system which is attached to a wellhead. However, components or systems attached to the wellhead can limit the clearance otherwise available above the wellhead.

SUMMARY

In general, a system and methodology are provided for use with a wellhead to maintain sufficient clearance between the wellhead and, for example, a mobile rig. The system and methodology enable support of a cable, e.g. an antenna suspension cable, at the wellhead without detrimentally affecting the desired clearance. According to an embodiment, a flange system is used in combination with a cable clamp assembly at a wellhead. The flange system may comprise a flange having a connector portion configured for coupling with the wellhead. The flange also comprises an additional portion, e.g. a cylinder portion, coupled to the connector portion such that the additional portion extends into a corresponding bore of the wellhead. The cable clamp assembly is configured to clamp around and support a cable extending down through the wellhead. The cable clamp assembly is supported within the additional/cylinder portion of the flange such that the cable clamp assembly is at least partially disposed within the wellhead.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
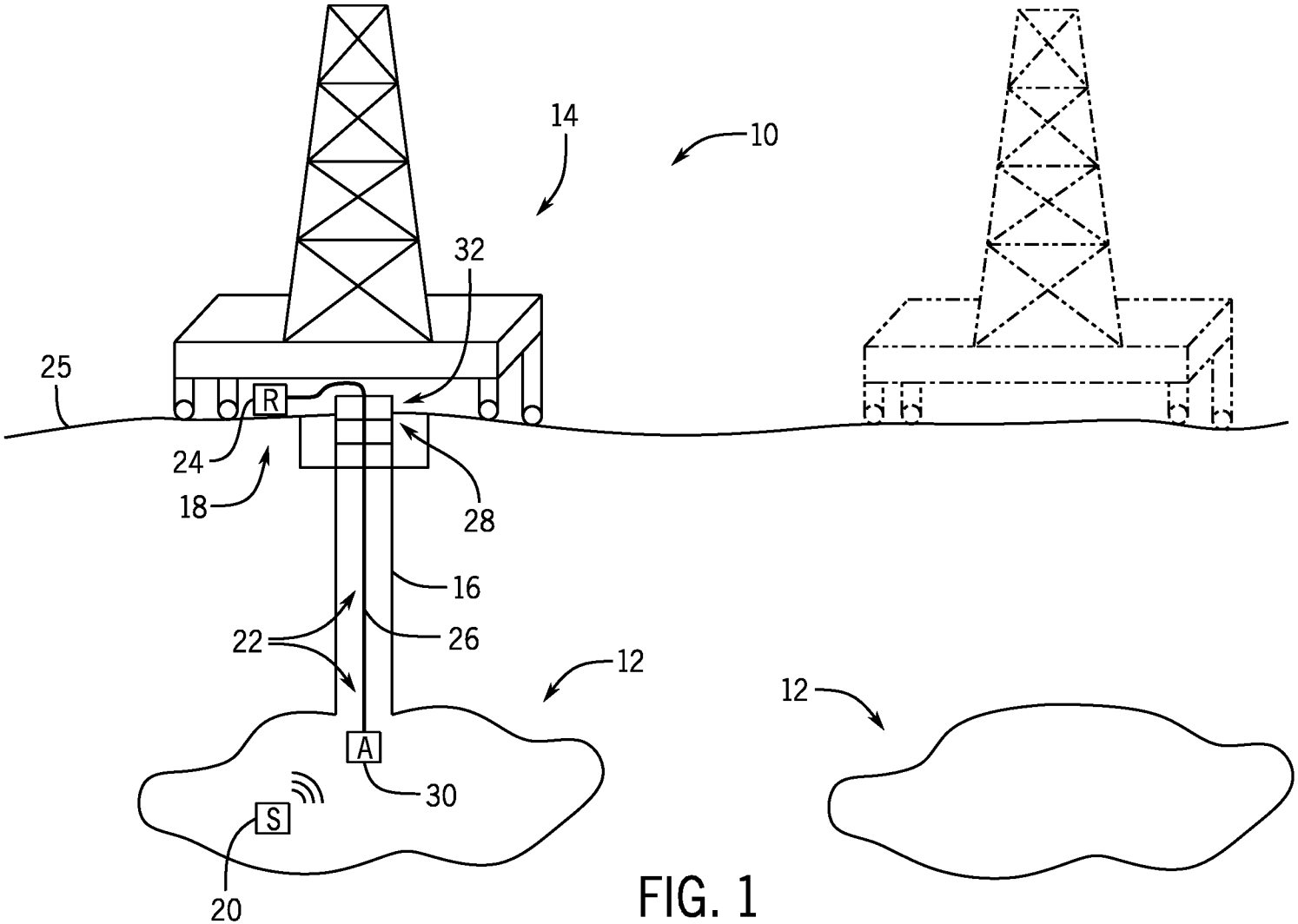
FIG. 1 is a schematic illustration of an example of a drill site with a mobile rig movably positioned over a well, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate use of a telemetry system mounted to a wellhead while maintaining sufficient clearance between the wellhead and, for example, a mobile rig. The system and methodology enable support of a cable, e.g. an antenna suspension cable, at the wellhead without detrimentally affecting the desired clearance. According to an embodiment, a flange system is used in combination with a cable clamp assembly at the wellhead.

The flange system may comprise a flange having a connector portion configured for coupling with the wellhead. The flange also comprises an additional portion, e.g. a cylinder portion, coupled to the connector portion such that the additional portion extends into a corresponding bore of the wellhead. In some embodiments, the additional portion may be constructed to define a recess with a ledge. The cable clamp assembly is configured to clamp around and support a cable extending down through the wellhead. The cable clamp assembly is supported within the additional portion of the flange such that the cable clamp assembly is at least partially disposed within the wellhead. In some embodiments, the cable clamp assembly may be supported by the ledge within the recess of the additional/cylinder portion.

By way of example, wells may be monitored during drilling operations, during production operations, and even after production operations are completed. For example, the temperature and pressure in the well may be monitored by one or more sensors disposed along a wellbore or at other suitable locations. To facilitate communication with the sensors, an antenna may be lowered into the well, e.g. lowered into the wellbore. By lowering the antenna into the well, the distance between the antenna and the sensors is reduced and this reduced distance can facilitate data collection while enhancing data accuracy. As the antenna receives data from the sensors, the data is transmitted from the antenna, through a cable, and to a receiver on the surface. By way of example, the receiver may be part of a telemetry system positioned at least in part on a wellhead located at a surface.

In some surface drilling operations, a mobile rig may be moved between wells, e.g. moved from a well that is inactive to a subsequent well. For example, the mobile rig may be moved and used to drill another well or to service another well, e.g. to service a wellhead. However, the clearance between the mobile rig and the ground may be limited. Devices attached to the wellhead can therefore block movement of the mobile rig without prior disassembly or detachment from the wellhead. For example, traditional electromagnetic telemetry systems can obstruct movement of the mobile rig. As a result, such electromagnetic telemetry systems are withdrawn from the well and detached from the wellhead to provide sufficient clearance for movement of the mobile rig over the wellhead. Once the mobile rig passes over the wellhead, the traditional electromagnetic telemetry system may again be lowered into the well and coupled to the wellhead. This process, however, tends to be expensive and time-consuming.

In embodiments described herein, a flange system is constructed to provide a wellhead cable clamp system that couples to a wellhead. The flange system may be used to support a cable, such as electromagnetic telemetry system cable. However, the flange system is configured to provide sufficient clearance between the wellhead and the mobile rig. The sufficient clearance enables the mobile rig to freely move over the wellhead without disconnecting the flange system/electromagnetic telemetry system from the wellhead.

Referring generally to FIG. 1, an example of a drill site 10 is illustrated schematically. The drill site 10 may be located over a hydrocarbon reserve 12 or over multiple hydrocarbon reserves 12 containing, for example, oil and gas. A mobile rig 14 may be positioned over the hydrocarbon reserve 12 to enable servicing of a well 16. By way of example, servicing the well 16 may include drilling, installing well equipment, and/or other services and operations. After servicing the well 16, the mobile rig 14 may be moved to another location as represented by the mobile rig shown in dashed lines. Depending on the application, the mobile rig 14 may be moved to another location to drill another well or to service another well, e.g. to perform a service operation in or through a wellhead.

As illustrated, a well monitoring system 18 may be installed to monitor a condition or conditions of the well 16. In some applications, the well monitoring system may be installed to monitor an inactive well 16. The monitoring system 18 may include one or more sensors 20 and a telemetry system 22 able to facilitate communication between the sensors and a receiver 24. By way of example, the receiver 24 may be positioned at a surface location 25. The telemetry system 22 may be in the form of an electromagnetic telemetry system or other suitable telemetry system which facilitates communication between the sensor or sensors 20 and the receiver 24.

In the example illustrated, the telemetry system 22 includes a cable 26 suspended from a wellhead 28. In this example, the cable 26 supports an antenna 30 which receives signals from the sensor(s) 20. From the antenna 30, the signals are transferred through the cable 26 to the receiver 24. The receiver 24 may comprise a processor, e.g. a microprocessor, for processing the signals received. By using antenna 30 suspended via cable 26 in well 16, the well monitoring system 18 is able to receive sensor data more rapidly and with increased accuracy.

The cable 26 may be suspended in well 16 with a flange system 32 coupled with the wellhead 28. By way of example, the flange system 32 helps enable a low profile wellhead cable clamp system as discussed in greater detail below. The flange system 32 is constructed to provide increased clearance between the mobile rig 14 and the wellhead 28 while suspending the cable 26. By creating space between the mobile rig 14 and the wellhead 28, the flange system 32 enables the mobile rig 14 to move without disconnecting the telemetry system 22 from the wellhead 28. The flange system 32 also enables suspension of other equipment in the wellhead 28. Examples of such other equipment include line cutters, pressure equipment, and/or other well related equipment.

Figure 2:
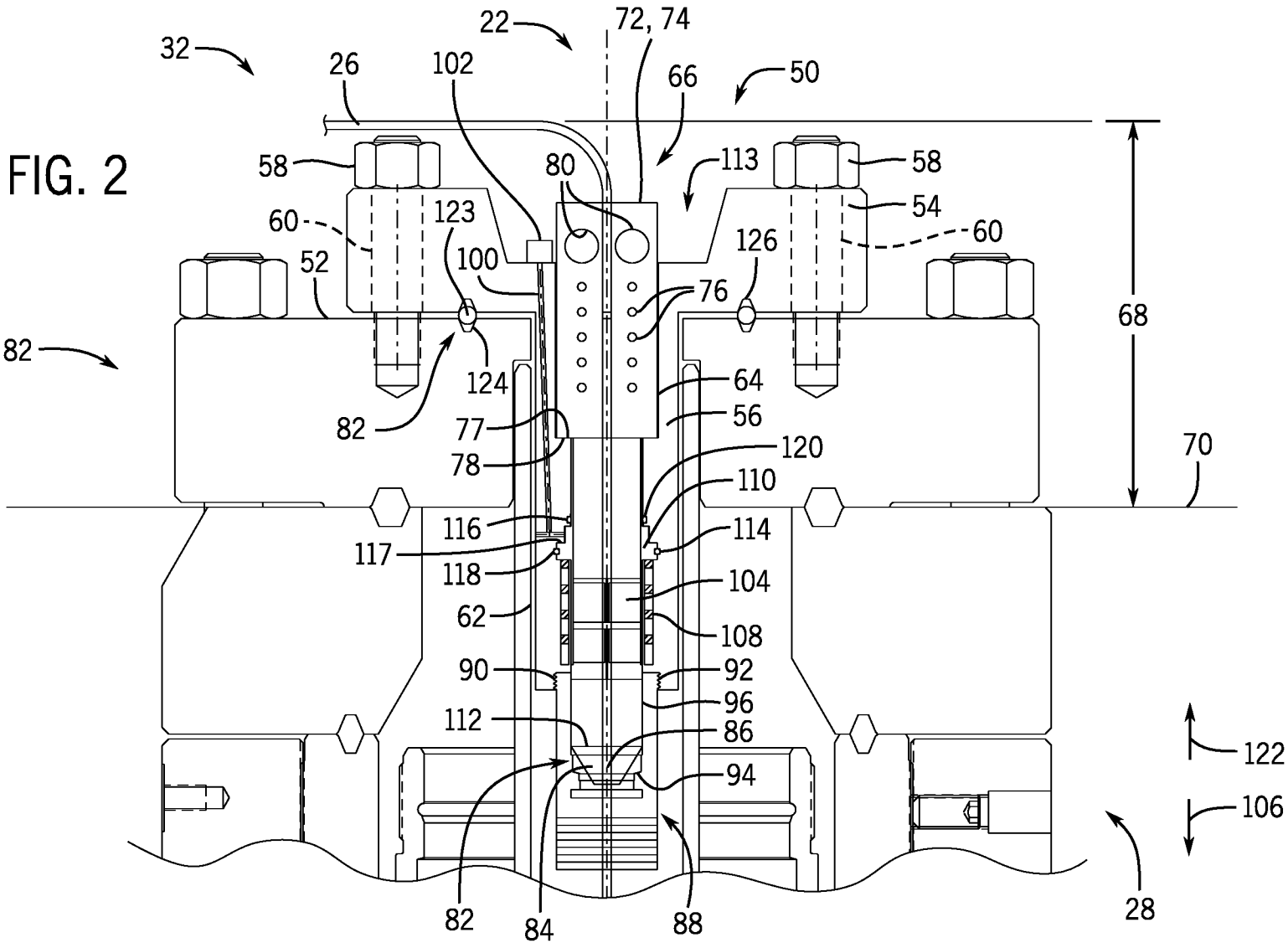
FIG. 2 is a schematic cross-sectional illustration of an example of a flange system coupled to a wellhead and combined with a cable clamp assembly, according to an embodiment of the disclosure.

Referring generally to FIG. 2, an embodiment of flange system 32 is illustrated as coupled to wellhead 28 while supporting telemetry system 22. In this example, the flange system 32 comprises a flange 50 which couples to the wellhead 28. For example, the flange 50 may be coupled to a distal end surface 52 of the wellhead 28. The distal end surface 52 is illustrated as the top surface of wellhead 28 in FIG. 2.

According to an embodiment, the flange 50 includes two portions in the form of a connector portion 54 and an additional portion 56, e.g. a cylinder portion. The connector portion 54 may be coupled to the wellhead 28 via one or more bolts 58 or by other suitable fastening techniques. In the illustrated example, bolts 58 are positioned through apertures 60, formed in the connector portion 54, and threadably engaged with the wellhead 28.

In the embodiment illustrated, additional portion 56 is in the form of a cylinder portion coupled to the connector portion 54 and positioned to extend into a passage, e.g. bore, 62 defined by the wellhead 28. It should be noted the bore 62 may be formed by drilling, casting, milling, and/or other suitable formation techniques. In some embodiments, the connector portion 54 and the cylinder portion 56 are one-piece in that they are integrally constructed. The connector portion 54 and the cylinder portion 56 also may be threadably coupled, welded together, and/or otherwise joined to each other.

In the embodiment illustrated, the cylinder portion 56 defines a recess 64, e.g. a bore, that receives a cable clamp assembly 66. In the illustrated example, the recess 64 extends down below the connector portion 54. By receiving the cable clamp assembly 66 at least partially within the flange 50 and the wellhead 28, the flange system 32 is able to reduce an overall height 68 of the combined wellhead 28 and telemetry system 22 with respect to a surrounding surface 70. Surface 70 may be the surface defining surface location 25. In some embodiments, the overall height 68 of the wellhead 28 combined with the cable clamp assembly 66 may be in the range 8-24 inches, 10-20 inches, or 12-18 inches above the surface 70.

According to the embodiment illustrated, the cable clamp assembly 66 comprises a first plate 72 and a second plate 74 coupled together with fasteners 76, e.g. bolts. The plates 72, 74 are constructed to clamp around a section of the cable 26 and to thus enable the cable 26 to be secured and suspended in the wellhead 28 once the cable clamp assembly 66 is supported by portion 56 of flange 50. By way of example, the portion 56, e.g. the cylinder portion, may support plates 72, 74 via a ledge 77 positioned and oriented to contact an end surface 78, e.g. a lower end surface, of the combined plates 72, 74.

In some embodiments, the plates 72, 74 may include insertion/retraction features 80 configured to enable coupling with a tool used for moving the cable clamp assembly 66. By way of example, the features 80 may be in the form of apertures which extend through the plates 72, 74, as illustrated in FIG. 2. However, the features 80 may have other configurations such as hooks, rings, and/or other suitable features or combinations of features.

To form a fluid tight seal between the flange system 32 and the wellhead 28, the flange system 32 may include a seal system 82. By way of example, the seal system 82 includes a seal 84 for sealingly engaging cable 26. In some embodiments, the seal 84 may be actuated to form a seal around the cable 26. For example, the seal 84 may define an aperture 86 surrounding the cable 26 so as to facilitate sealing engagement with the cable 26 when the seal 84 is compressed inwardly against the cable 26. In some embodiments, the seal 84 may have a conical shape to facilitate compression of the seal 84 against the cable 26.

Referring again to FIG. 2, the seal 84 may be placed within a retention member 88 which is coupled to the cylinder portion 56 of flange 50. In the example illustrated, the retention member 88 is in the form of a cylinder however non-cylindrical retention members 88 may be suitable in various applications. The cylinder 88 may be coupled to cylinder portion 56 via suitable coupling techniques, such as threaded coupling via mail threads 90 of cylinder 88 engaged with female threads 92 of cylinder portion 56. In addition to receiving the seal 84, cylinder 88 may receive a seal holder 94 which retains the seal 84 within a cylinder recess 96, e.g. a counterbore, of cylinder 88. In some embodiments, the cylinder 88 may define a conical section of the counterbore 96 which is configured to receive and retain seal 84 within cylinder 88 instead of seal holder 94. Effectively, the retention member 88 blocks removal of the seal 84 and of the overall seal system 82.

The seal 84 may be actuated by pumping a fluid into the recess/bore 64 which is defined by the interior surface of additional portion 56. As illustrated, the additional portion 56 of flange 50 further defines a fluid passage 100 routed to direct fluid from a port 102 to the recess 64. As fluid enters the recess 64, fluid pressure builds and drives a piston 104 in an axial direction 106. The piston 104 is located within (or at least partially within) the additional portion 56 of flange 50. As the piston 104 moves in axial direction 106, the piston 104 compresses a spring 108. In some embodiments, an annular rim 110 may be engaged with and disposed about the piston 104. As the spring 108 compresses, a piston end 112 of piston 104 engages and compresses the seal 84. As the seal 84 is compressed, it engages and seals against the interior of cylinder 88 and against the cable 26.

In the illustrated embodiment, the fluid port 102 may be located within a recess 113 formed within connector portion 54 of flange 50. By way of example, the recess 113 may be an annular recess formed in connector portion 54 on an opposite side of the connector portion 54 relative to wellhead 28. Placement of the fluid port 102 within the recess 113 helps prevent contact between the fluid port 102 and other equipment used at drill site 10. Additionally, placement of the fluid port 102 within recess 113 helps reduce the overall height of the flange system 32 and thus the overall height 68 of the combined wellhead 28 and telemetry system 22 with respect to the surrounding surface 70. In this manner, the configuration of the flange system 32 and cable clamp assembly 66 enables movement of the mobile rig 14 over wellhead 28 without disassembly of the monitoring system 18/telemetry system 22.

The seal system 82 also may include other components such as seals 114, 116 which form sealing engagements between the cylinder portion 56 and the piston 104. Seals 114, 116 serve to form an actuation chamber 117 between the piston 104 and the cylinder portion 56 in a manner which enables fluid pressure to drive axial movement of the piston 104 in direction 106. In some embodiments, the seal 114 may be located within a corresponding groove 118, e.g. an annular groove, located on piston 104. Locating seal 114 in groove 118 facilitates movement of the seal 114 with piston 104. Similarly, the seal 116 may be located within a corresponding groove 120 located in the cylinder portion 56. However, the positions of the seals 114, 116 as well as their corresponding grooves 118, 120 may be adjusted or configured differently to establish actuation chamber 117 and to facilitate the desired movement of piston 104.

To release seal 84, the pressure in actuation chamber 117 and fluid passage 100 may be released through the port 102. As pressure decreases, the spring 108 drives the piston 104 in an axial direction 122. As the piston moves in axial direction 122, the pressure of the piston 104 acting on the seal 84 is reduced, e.g. released. This allows the seal 84 to decompress which helps accommodate movement of the cable 26 through the seal 84 and the piston 104.

The seal system 82 also may comprise one or more seals 123, e.g. annular seals, located between flange 50 and the distal end surface 52 of the wellhead 28 to effectively form a seal around the bore 62. The seals 123 may be metal seals, elastomer seals, rubber seals, or other suitable types of seals or combinations of seals. As illustrated, the seal 123 rests within a corresponding recess 124, e.g. an annular recess, formed in the wellhead 28 and within a corresponding recess 126 formed in flange 50.

Figure 3:
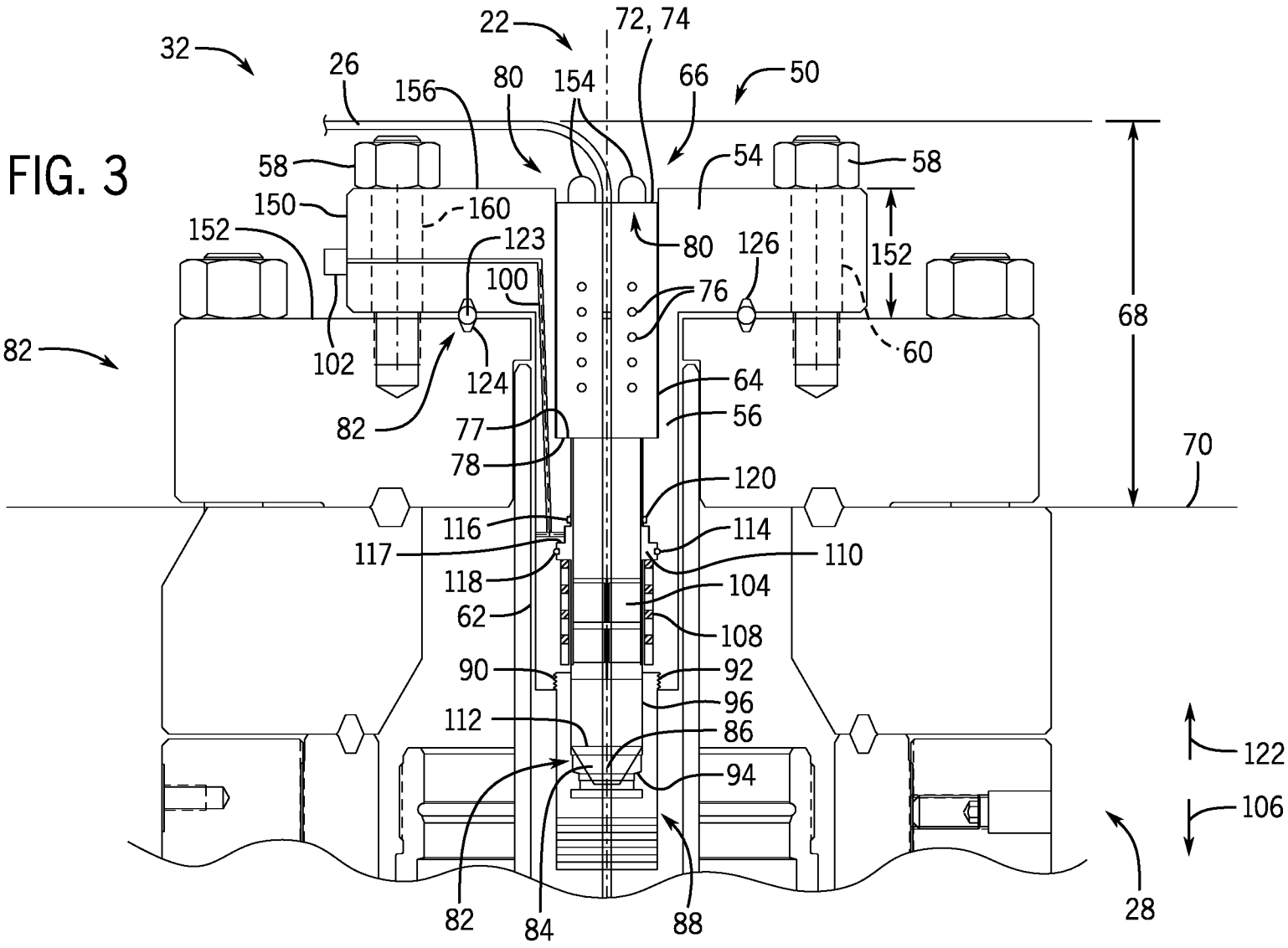
FIG. 3 is another schematic cross-sectional illustration of an example of a flange system coupled to a wellhead, according to an embodiment of the disclosure.

Referring generally to FIG. 3, another embodiment of flange system 32 is illustrated as coupled to wellhead 28. In this example, the fluid port 102 is located on a side surface 150 of the connector portion 54. This allows the connector portion 54 of flange 50 to have a uniform or substantially uniform thickness 152. Placement of the fluid port 102 on the side surface 150 also reduces the overall height of the flange system 32 and thus the overall height 68 of the combined wellhead 28 and telemetry system 22 with respect to surrounding surface 70. Again, the structure of the flange system 32 and cable clamp assembly 66 forms an overall wellhead cable clamp system able to facilitate movement of a mobile rig 14 over wellhead 28 without disassembly of the monitoring system 18/telemetry system 22 supported therein.

In this embodiment, the cable clamp assembly 66 comprises one or more rings 154 which are used as the insertion/retraction feature 80. The rings 154 may be coupled to the first plate 72 and/or second plate 74 at a position which enables coupling with a tool used for insertion and/or retraction of the cable clamp assembly 66. While the rings 154 are illustrated as extending beyond a distal end surface 156 of flange 50, some embodiments of rings 154 may be flush with or below the distal end surface 156.

Figure 4:
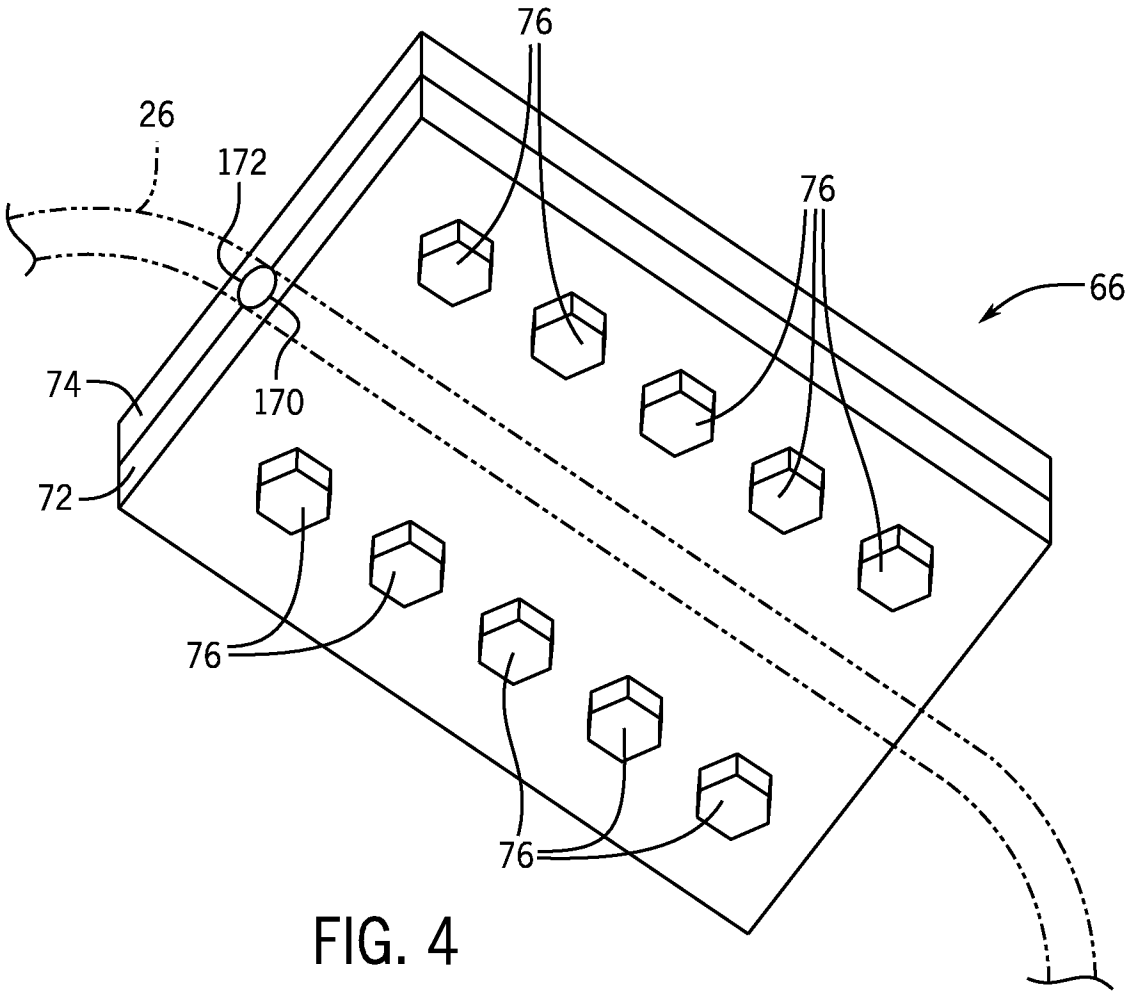
FIG. 4 is an orthogonal view of an example of a cable clamp assembly which may be used to suspend a cable, according to an embodiment of the disclosure.

Referring generally to FIG. 4, an embodiment of the cable clamp assembly 66 is illustrated. As discussed above, the cable clamp assembly 66 may include plates 72, 74 coupled together with bolts 76 or other suitable fastening devices or techniques. In the illustrated example, the plates 72, 74 include semicircular grooves 170, 172, respectively. The grooves 170, 172 are positioned along the length of plates 72, 74 and oriented toward one another so as to receive the cable 26. When the cable 26 is positioned along grooves 170, 172 and the plates 72, 74 are tightened against each other via bolts 76, the cable 26 is secured between plates 72 and 74. Sufficient tightening of bolts 76 secures the cable 26 to prevent movement of the cable 26 through the cable clamp assembly 66 during use of, for example, antenna 30 at a downhole location. In this manner, the flange system 32 and the cable clamp assembly 66 are able to support monitoring system 18/telemetry system 22 while maintaining a low profile to accommodate movement of rig 14 above wellhead 28.

Figure 5:
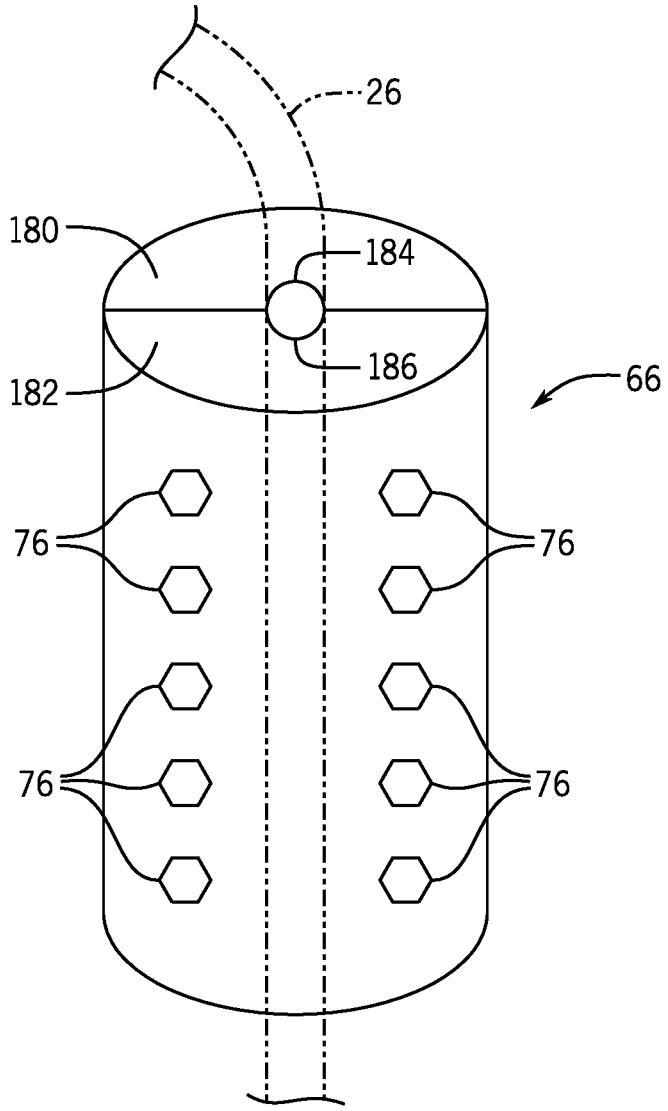
FIG. 5 is an orthogonal view of another example of a cable clamp assembly which may be used to suspend a cable, according to an embodiment of the disclosure.

Referring generally to FIG. 5, another embodiment of cable clamp assembly 66 is illustrated. In this embodiment, the cable clamp assembly 66 is formed from semicircular shafts 180 and 182 which are coupled together with bolts 76 or other suitable fasteners. The semicircular shafts 180, 182 receive the cable 26 therebetween. For example, the semicircular shafts 180, 182 may have semicircular grooves 184, 186, respectively, oriented to receive the cable 26. In the illustrated example, the grooves 184, 186 extend along the lengths of the semicircular shafts 180, 182 and are oriented toward each other so as to receive the cable 26. When the cable 26 is positioned along grooves 184, 186 and the semicircular shafts 180, 182 are tightened against each other via bolts 76, the cable 26 is secured. Sufficient tightening of bolts 76 secures the cable 26 to prevent movement of the cable 26 through the cable clamp assembly 66 during use of, for example, antenna 30 at a downhole location.

Figure 6:
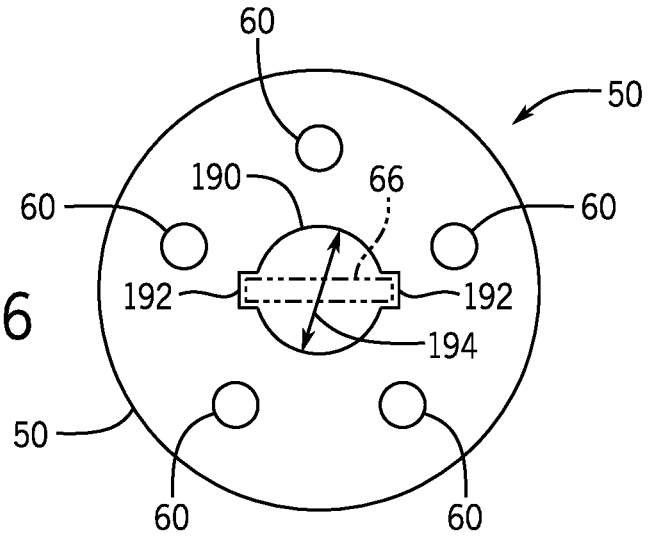
FIG. 6 is a top view of a flange which may be coupled to a wellhead, according to an embodiment of the disclosure.

In FIG. 6, a top view of one embodiment of flange 50 is illustrated. In this example, the flange 50 has a plurality of the apertures 60 which are sized to receive bolts 58 when coupling the flange 50 to wellhead 28. The flange 50 also may include the recess/bore 64 which is appropriately configured to receive the corresponding cable clamp assembly 66. The cable clamp assembly 66 may have a variety of configurations and may, for example, include plates 72, 74 or semicircular shafts 180, 182 for securely coupling and supporting the cable 26. Once the cable clamp assembly 66 is placed in the bore 64, the flange 50 and cable clamp assembly 66 are able to support the cable 26 within the well 16.

According to some embodiments, the flange 50 may have a bore 64 which is irregular in shape and sized to receive and support cable clamping assemblies 66 of different shapes. For example, the bore 64 may be defined by semicircular surfaces 190 which enable the flange 50 to receive a circular shaped cable clamp assembly 66 such as that shown in FIG. 5. The bore 64 also may be constructed with square/rectangular surfaces 192 which are configured so the flange 50 is able to receive square/rectangular cable clamp assemblies such as that shown in FIG. 4. Furthermore, the square/rectangle or surfaces 192 may be constructed to enable the flange 50 to receive a square/rectangular cable clamp assembly 66 having a width which is greater than the diameter 194 of the bore 64.

Depending on the parameters of a given well application, the features of the monitoring system 18, telemetry system 22, and wellhead 28 may vary. For example, the monitoring system 18 may include a variety of sensors, cables, receivers, and processing systems. In some embodiments, the receiver may comprise a computer-based processing system which is able to receive and process data transmitted uphole from antenna 30. Similarly, the flange system 32, cable clamp assembly 66, seal system 82, and/or other systems may have a variety of components and features to facilitate parameters of a given operation while enabling movement of the mobile rig 14 without disassembling the monitoring system 18/telemetry system 22.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a wellhead, the wellhead defining a central passage therethrough;

a flange system, the flange system comprising:

a flange having:

a connector portion configured to couple with the wellhead; and a central portion coupled to the connector portion, the central portion extending into the central passage of the wellhead and defining a recess with a ledge; and a cable clamp assembly configured to clamp around a cable to support the cable in the wellhead, the cable clamp assembly being at least partially recessed into the recess of the central portion and supported by the ledge within the central portion of the flange, the cable clamp assembly being at least partially disposed within the wellhead.

2. The system as recited in claim 1, wherein the recess within the central portion extends axially below the connector portion.

3. The system as recited in claim 1, wherein the flange system comprises a seal system to seal around the cable.

4. The system as recited in claim 3, wherein the seal system comprises a seal configured to surround the cable.

5. The system as recited in claim 4, wherein the seal system comprises a piston at least partially disposed within the central portion of the flange, wherein the piston is coaxial with the central portion in the central passage.

6. The system as recited in claim 5, wherein the flange defines a fluid passage through the central portion, the fluid passage enabling a fluid to drive the piston in an axial direction such that axial movement of the piston actuates the seal to sealingly engage the cable.

7. The system as recited in claim 6, wherein the fluid passage comprises a fluid port disposed in an axial recess of the connector portion.

8. The system as recited in claim 6, wherein the fluid passage comprises a fluid port disposed in a lateral sidewall of the connector portion.

9. The system as recited in claim 5, wherein the seal system comprises a spring surrounding the piston, the spring being positioned to bias the piston axially in a direction to release the seal.

10. The system as recited in claim 3, further comprising a retention member coupled to the central portion of the flange to block removal of the seal system.

11. The system as recited in claim 1, wherein the connector portion and the central portion are formed as a unitary piece.

12. The system as recited in claim 1, wherein the cable clamp assembly comprises one or more fasteners between first and second clamp sections, wherein the first and second clamp sections and the one or more fasteners are at least partially recessed into the recess of the central portion.

13. The system as recited in claim 1, wherein the recess is configured to block rotation of the cable clamp assembly within the central portion.

14. The system as recited in claim 13, wherein the recess comprises a central opening and one or more slots in a sidewall of the central opening.

15. The system as recited in claim 1, wherein the cable clamp assembly comprises first and second flat plates coupled together with one or more fasteners.

16. A system, comprising:

a flange system, comprising:

a flange comprising:

a connector portion configured to couple to a component having a central passage; and a central portion coupled to the connector portion, wherein the central portion is configured to extend into the central passage of the component, and the central portion comprises a recess extending axially into the central portion to a ledge; and a cable clamp assembly configured to clamp around a cable to support the cable in the central passage of the component, wherein the cable clamp assembly is configured to be at least partially recessed axially into the recess of the central portion and supported by the ledge within the central portion of the flange, and the cable clamp assembly is configured to be at least partially disposed within the component.

17. The system as recited in claim 16, wherein the component comprises a wellhead.

18. The system as recited in claim 16, wherein the cable clamp assembly comprises one or more fasteners between first and second clamp sections, wherein the first and second clamp sections and the one or more fasteners are at least partially recessed axially into the recess of the central portion.

19. The system as recited in claim 18, wherein the first and second clamp sections comprises first and second flat plates, respectively.

20. The system as recited in claim 16, wherein the flange system comprises a seal system having a seal configured to surround the cable and a piston at least partially disposed within the central portion of the flange, wherein the piston is coaxial with the central portion in the central passage.

* * * * *